United States Patent [19]

Yellin

[11] 4,194,601

[45] Mar. 25, 1980

[54] COMBINATION BODY REST AND TOTEBAG

[76] Inventor: Kathleen F. Yellin, 3627 Serra Rd., Malibu, Calif. 90265

[21] Appl. No.: 887,944

[22] Filed: Mar. 20, 1978

[51] Int. Cl.[2] ..... A45C 9/00

[52] U.S. Cl. ..... 190/2; 5/431; 190/8; 297/377

[58] Field of Search ..... 5/317, 327 R, 327 B, 5/341, 344; 297/129, 350, 377; 190/8, 2

[56] References Cited

U.S. PATENT DOCUMENTS

| | | | |
|---|---|---|---|
| 2,304,700 | 12/1942 | Manville | 297/377 |
| 2,308,410 | 1/1943 | Winter | 297/377 |
| 2,543,597 | 2/1951 | Peery | 5/344 |
| 2,570,571 | 10/1951 | Leeman | 297/129 |

*Primary Examiner*—Casmir A. Nunberg
*Attorney, Agent, or Firm*—Paul L. Gardner

[57] ABSTRACT

A combination body rest (for lounging at the beach, for example) and totebag includes a pair of frame members hinged at the tops thereof and covered with fabric so as to form a storage compartment. The unit further includes a seat panel adapted to serve as a ground cover when the unit is used as a body rest. Tabs provided with cooperating snap fasteners are secured to the bottom portions of the frame members. The tabs are adapted to be fastened to one another when the unit is carried as a totebag to (1) hold the bottoms of the frame members relatively close to one another, (2) provide added support for the contents of the storage compartment, and (3) maintain the seat panel in a rolled-up, out-of-the-way position beneath the storage compartment. When the unit is used as a body rest the tabs are unsnapped to permit the bottom portions of the frame members to be moved further away from one another and provide a relatively sturdy base, and to release the seat panel so that it may be unrolled to serve as a ground cover for the user's seat and legs. A head cushion designed to be wrapped around the top portions of the frame members to cushion the user's head when the unit is employed as a body rest may be conveniently carried in the storage compartment when the unit is carried as a totebag.

5 Claims, 6 Drawing Figures

FIG. 1.
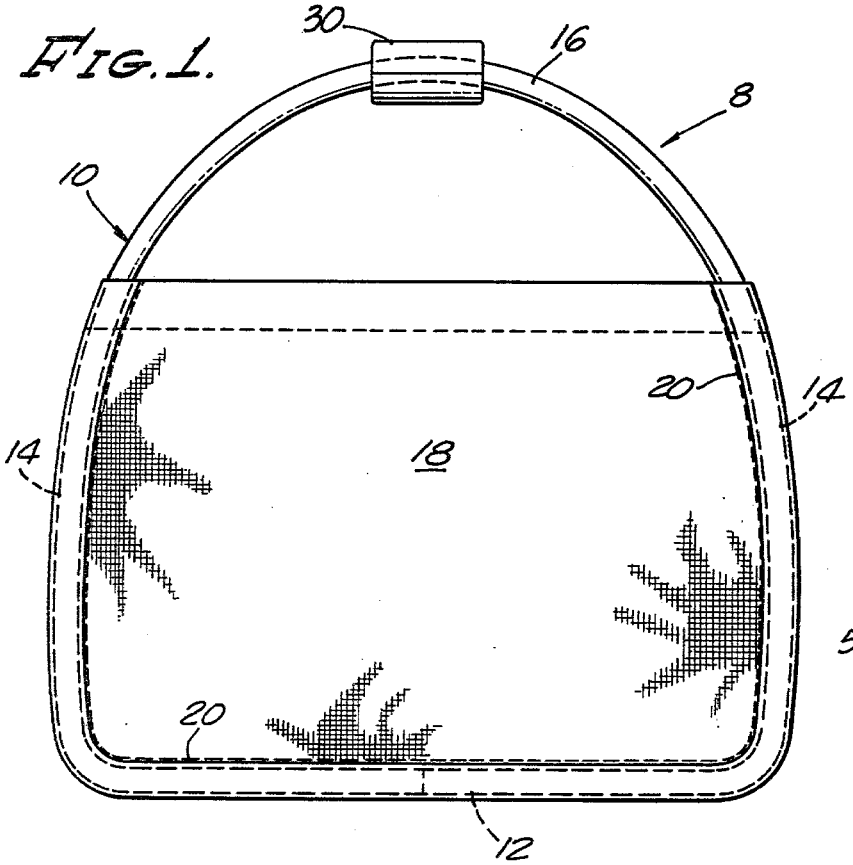
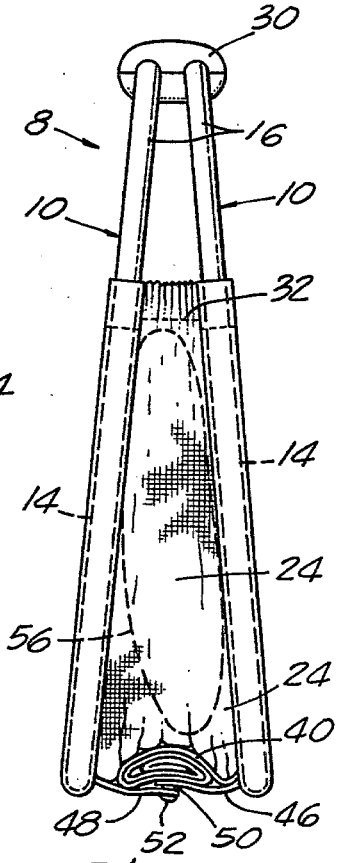
FIG. 2.
FIG. 3.
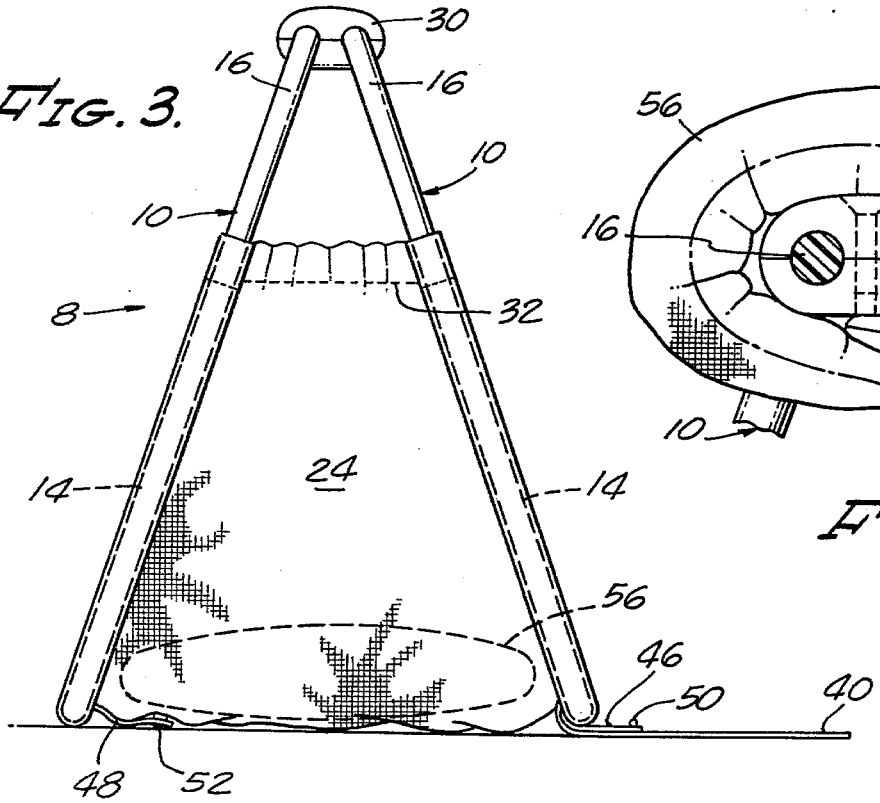
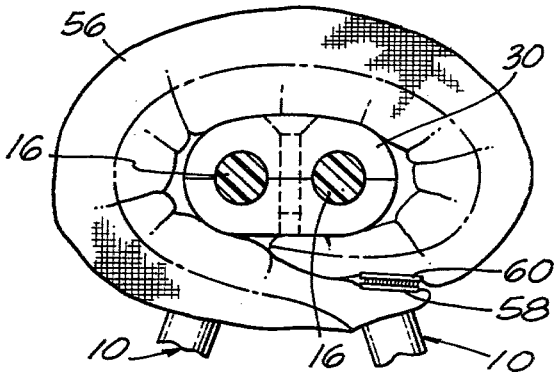
FIG. 6.

10
14
18
20
12
46
50
40
24
32
34
8
16
30
6
5
56
60
58

COMBINATION BODY REST AND TOTEBAG

FIELD, BACKGROUND AND OBJECTS OF THE INVENTION

The present invention relates to a combination body support-totebag unit which may be used both as a body rest (at the beach, for example) and for storing and carrying items.

Portable and/or collapsable body rests, are shown in U.S. Pat. Nos. 2,570,571; 2,816,599; 2,710,646; 3,822,424; 2,509,420; 2,542,820; 2,304,700; 2,843,181; 2,108,531; and 2,121,100. The units shown in Pat. Nos. 2,570,571 and 2,816,599 are designed to function as containers when not in use as body rests; however, they cannot be used as storage containers while being used as body rests.

It is an object of the present invention to provide an improved combination body rest and totebag which overcomes the limitations of the prior art structures. For example, one of the objects of the present invention is to provide a combination body rest-totebag unit which functions as a storage container while being used as a body rest. Another object of the present invention is to provide a unit which is more attractive and which is easier to manufacture and use than the prior art units.

The foregoing and other objects and advantages of the present invention will become apparent from the accompanying drawings and the following detailed description which show and describe a preferred embodiment thereof. It is to be understood at the outset that while the unit described below and shown in the drawings is presently the preferred embodiment of the present invention, it is contemplated that various changes, additions, and/or modifications may be made to the preferred embodiment without departing from the spirit and scope of this invention.

BRIEF DESCRIPTION OF THE DRAWINGS

Figures 4, 5:
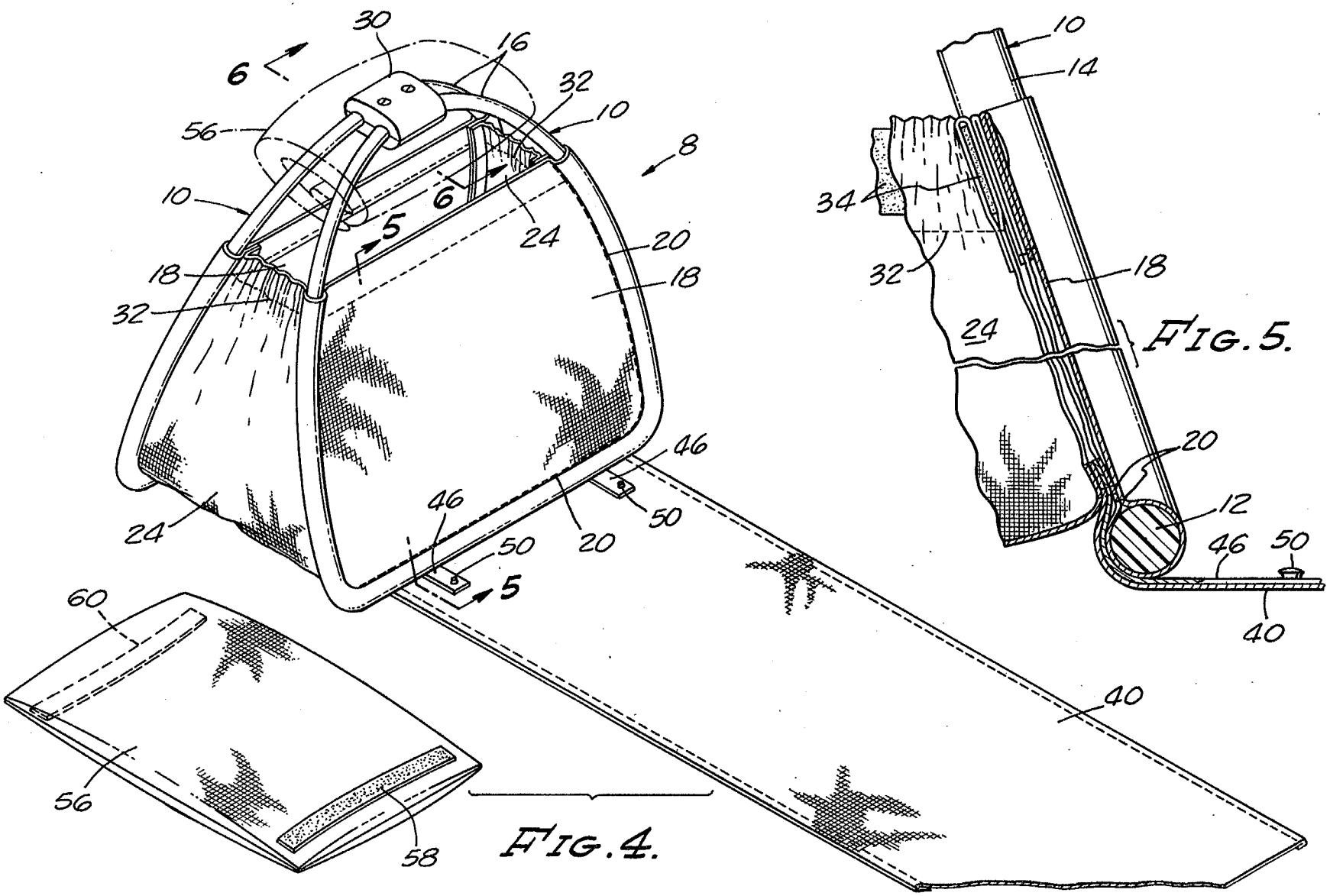

IN THE DRAWINGS:

FIG. 1 is a front elevation view of the combination body rest-totebag unit of the present invention as it appears during use as a totebag.

FIG. 2 is a side elevation view of the unit as shown in FIG. 1.

FIG. 3 is a side elevation view of the unit shown in FIGS. 1 and 2 as it appears when used as a body rest.

FIG. 4 is a perspective view of the unit shown in FIGS. 1 through 3 as it appears when used as a body rest and showing the head support cushion which is designed to be wrapped around the tops of the frame members of the unit (as illustrated in phantom lines).

FIG. 5 is a sectional side elevation view taken along the plane 5—5 of FIG. 4 and looking in the direction of the arrows.

FIG. 6 is a sectional elevation view taken along the plane 6—6 of FIG. 4, looking in the direction of the arrows and illustrating the manner in which the head support cushion is wrapped around the hinged, upper portions of the frame members of the unit.

DESCRIPTION OF PREFERRED EMBODIMENT

Referring to the preferred embodiment of the present invention shown in the drawings, the combination body rest-totebag unit 8 includes a pair of frame members 10, 10, each having a generally straight bottom section 12, a pair of upstanding side sections 14, 14 and a generally arcuate top section 16.

A panel of material 18 is secured to and covers the bottom and middle portions of the opening defined by each of the frame members 10. As best shown in FIG. 5, each of the panels 18 has its bottom edge portion wrapped around the bottom section 12 of the frame member 10 and secured to itself (e.g., as by stitching 20). Similarly, also as best shown in FIG. 5, each of the side edge portions of each panel 18 is wrapped around an upstanding side section 14 of a frame member 10 and secured to itself, e.g., as by stitching (not shown).

The embodiment of the combination body rest-totebag unit 8 shown in the drawings also includes a connecting panel of fabric 24 which extends between the frame members 10, 10 and the cover panels 18, 18 therefor and has its side and bottom edges secured to the panels 18, 18 (e.g., as by stitching, including stitching 20, FIG. 5). Thus, the cover panels 18, 18 and the connecting panel 24 form an open-top bag structure for storing and carrying items.

The arcuate top sections 16, 16 of the frame members 10, 10 are pivotably connected to one another by hinge member 30. The hinge member 30 permits the bottom and side portions of the frame members 10, 10 to pivot toward and away from each other, about the hinge 30, between the positions shown in FIG. 2 (wherein the bottoms of the frame members 10, 10 are relatively close to one another and the unit 8 may be conveniently carried as a totebag) and the position shown in FIG. 3 (wherein the bottoms of the frame members are relatively far apart to provide a stable base for use of the unit as a body rest).

As best shown in FIG. 5, the upper edge portions of the connecting panel 24 are preferably folded inwardly and secured to themselves (e.g., as by stitching 32) to form an enclosure for expandable (e.g., elastic) bands 34, 34. The expandable elastic bands 34, 34 permit full utilization of the relatively large storage compartment of the unit while minimizing the danger that stored items might fall out.

As shown in FIGS. 2 through 5, an elongated flap of material 40 is secured at one end (e.g., as by stitching 20, FIG. 5) to and between one of the cover panels 18 and the connecting panel 24. As shown in FIG. 2, when the unit 8 is used as a body rest (FIGS. 3, 4 and 5), the flap 40 is extended along the ground to serve as a ground cover for the user's seat and legs.

The unit 8 is provided with pairs of tabs 46, 46 and 48, 48, which are provided with cooperating snap fastner elements 50, 52, (FIGS. 2, 3 and 4). As shown in FIG. 2, when the unit 8 is employed as a totebag, the flap 40 is rolled up beneath the bottom of the connecting panel 24 and the cooperating pairs of snap fasteners 50, 52 are fastened to connect tabs 46, 48 and 46, 48 to retain the flap 40 in its rolled-up, out-of-the-way position and to provide added support for items stored in the storage compartment formed by the cover panels 18, 18 and connecting panel 24. Each set of tabs 46, 48 is unfastened (as shown in FIG. 3) when the unit 8 is to be employed as a body rest to permit expansion of the bottom portion of the connecting panel 24 and movement of the bottom sections of the frame members 10, 10 away from one another to form a relatively stable base.

As best shown in FIGS. 4 and 6, the unit 8 of the present invention is provided with a head cushion 56 which may be wrapped around the hinged, arcuate top sections 16, 16 of the frame member 10, 10 to cushion the user's head when the unit is employed as a body rest. The cushion 56 is preferably in the form of a somewhat elongated pillow containing cushion material (e.g., foam) having pile and loop type (i.e., Velcro) fastening elements 58, 60 near the ends thereof to facilitate detachably securing the cushion 56 in wrapped condition around the top sections of the frame members 10, 10 (see FIG. 6). As shown in phantom lines in FIG. 2, the head cushion 56 may conveniently be stored and carried in the unit 8.

From the foregoing, it will be appreciated that the combination body rest-totebag unit of the present invention is an attractive unit which may conveniently be utilized as a totebag (FIG. 2) or a body rest (FIG. 4) as desired. Moreover, it will be appreciated that the unit 8 functions as a storage container even when employed as a body rest (FIG. 4).

While a preferred embodiment of the present invention has been shown in the drawings and described above, it is contemplated that numerous modifications, changes and/or additions may be made to the preferred embodiment without departing from the spirit and scope of the present invention. Accordingly, it is intended that the scope of this invention be limited only by the scope of the appended claims.

I claim:

1. A combination body rest-totebag unit, comprising:

a pair of substantially continuous peripheral frame members, each defining an open area therewithin;

each of said frame members comprising a bottom section, a pair of upstanding side sections extending upwardly from said bottom section and having upper portions, and a top section extending between and connecting the upper portions of said side sections;

a cover panel having a peripheral edge portion secured to said bottom section and parts of said side sections of each of said frame members beneath said upper portions thereof so as to cover a substantial portion of said open area;

a connecting panel extending between and connected to said peripheral edge portions of said cover panels;

said cover panels and said connecting panel defining an open-top container having a compartment for retaining items to be stored and/or carried; said connecting panel including end edge portions which form portions of the upper peripheral edge defining the opening in the top of the container;

hinge means pivotably connecting said top sections of said frame members to one another in a manner to permit movement of said bottom and side sections of said frame members toward and away from one another;

the said connecting panel having a width limiting the distance said bottom sections of said frame members may be moved away from one another;

cooperating tab members connected to said bottom sections of said frame members and provided with detachable fastening elements for detachably connecting said tabs to one another so as to limit the maximum distance the bottom sections of said frame members can be moved away from one another and for providing added support for items in said container compartment when said unit is used as a totebag;

a seat panel having a portion secured to one of said cover panels adjacent said bottom section of its respective frame member; said seat panel being adapted to be retained in a rolled-up condition by said tab members when said tab members are fastened to one another, and to be unrolled to serve as a ground cover when the unit is used as a body support;

elastic band means connected to said upper ends of said connecting panel to permit expansion of the container opening while minimizing the chance that items in the container will fall out; and a head cushion member adapted to be wrapped around said hinge member to cushion the user's head when the unit is employed as a body rest; said head cushion having detachable fastening elements for securing said head cushion being adapted to be carried in said container compartment when the unit is employed as a totebag.

2. A combination body rest-totebag unit, comprising:

a frame structure and relatively soft fabric material secured thereto; said fabric material forming the peripheral walls and bottom of a totebag; said fabric material also including a fold-out portion to cover the ground for the user's seat and legs when the unit is employed as a body rest;

said frame structure including a pair of relatively rigid frame members; each of said frame members including a top portion having outer ends, first and second side arms extending downwardly from said outer ends of said top portion and terminating in bottom ends, and a bottom portion extending between said bottom ends of said first and second side arms; said top portions of said frame members being hingedly connected to one another to permit the bottom portions thereof to be moved toward and away from one another;

said relatively soft fabric material including material extending between said first side arms of said frame members, material extending between said second side arms of said frame members, material extending between said bottom portions of said frame members, and material extending between said first and second side arms of each of said frame members.

3. A combination body rest-totebag unit according to claim 2, and further including means for detachably connecting the frame members so as to limit the distance said side sections of said frame members may be moved away from one another when said unit is used as a totebag.

4. A combination body rest-totebag unit according to claim 2, and further comprising a head cushion adapted to be detachably secured to said top sections of said frame members for when the unit is employed as a body support, and adapted to be carried in said storage compartment when the unit is employed as a totebag.

5. A combination body rest-totebag unit, comprising:

a frame structure and relatively soft fabric material secured thereto; said fabric material forming the peripheral walls and bottom of a totebag; said fabric material also including a fold-out portion to cover the ground for the user's seat and legs when the unit is employed as a body rest;

said frame structure includes a top portion having opposite end portions; said frame structure further including a pair of first legs extending downwardly from one of said opposite ends of said top portion, a pair of second legs spaced from said pair of first legs and extending downwardly from said other end portion of said top portion, and a bottom arm extending between the bottoms of one of said first legs and one of said second legs; and hinge means permitting movement of all but the top portions of said pairs of first and second legs away from one another and for permitting movement of said bottom arms away from one another.

* * * * *